United States Patent [19]

Owen et al.

[11] 4,077,468

[45] Mar. 7, 1978

[54] FLUID HEATER

[75] Inventors: Marshall L. Owen, Lafayette; Rudolf F. Nissen, Los Gatos, both of Calif.

[73] Assignee: Owen Power Industries, Inc., Old Sacramento, Calif.

[21] Appl. No.: 731,226

[22] Filed: Oct. 12, 1976

[51] Int. Cl.[2] ..... F28D 7/10

[52] U.S. Cl. ..... 165/159; 122/3; 122/250 R

[58] Field of Search ..... 165/156, 163; 122/3, 122/248-253, 261; 431/168; 62/5

[56] References Cited

U.S. PATENT DOCUMENTS

| | | | |
|---|---|---|---|
| 1,383,408 | 7/1921 | Leister | 122/261 |
| 1,703,228 | 2/1929 | French | 122/3 |
| 2,160,644 | 5/1939 | Clarkson | 122/250 R |
| 3,336,910 | 8/1967 | Taylor | 122/250 R |
| 3,693,599 | 9/1972 | Andreer et al. | 165/163 |
| 3,895,608 | 7/1975 | Sukhuja | 122/3 |

*Primary Examiner*—Charles J. Myhre

*Assistant Examiner*—Theophil W. Streule, Jr.

*Attorney, Agent, or Firm*—Warren, Chickering & Grunewald

[57] ABSTRACT

A fluid heater which includes a housing having a curved outer wall and two flat walls with a tangential inlet for hot gas in the curved wall, and a central outlet for exhaust gas in one flat wall, and having within it a stack of flat helices of tubing for carrying the fluid to be heated in a plurality of parallel paths, and with a first fluid passageway connecting from the outside of the housing to the inner turn of each helix, and a second fluid passageway connecting from the outside of the housing to the outer turn of each helix, and with the first fluid passageway being positioned between adjacent helices to be in contact with the tubes of adjacent helices, correspondingly located with respect to the first passageways of other helices, and bending toward the inner turn of each helix in the direction of hot gas flow from the periphery toward the center of the housing is disclosed.

6 Claims, 4 Drawing Figures

FLUID HEATER

BACKGROUND OF THE INVENTION

Criteria for designing heaters for fluids have long been known. In ordinary circumstances usual engineering criteria can produce a heater that will provide enough heat transfer to produce the desired amount of heated or vaporized fluid at the desired pressure and with the desired amount of superheat. However, in some circumstances the use of ordinary heater design criteria is not successful in producing a useful heater. One typical example where ordinary heater designs are not useful is in the design of vapor generators to drive external combustion engines for highway vehicles.

To be useful as a vapor generator for a highway vehicle, the fluid heater must produce large amounts of super-heated vapor at superatmospheric pressure; it must be capable of producing vapor at working pressure within seconds of starting; it must be small enough to be conveniently carried on a highway vehicle, for example, under the hood of an automobile; and it should be able to use fuel that can be safely carried and used without causing intolerable atmospheric pollution. Thus, the vapor generator must employ an easily carried liquid or powdered solid combustible fuel rather than fuels that must be maintained at high pressure which are too dangerous in highway vehicles, or nuclear fuels which are too dangerous, cause intolerable pollution, and are unavailable because of their strategic value.

SUMMARY OF THE INVENTION

This invention is a fluid heater or vapor generator which is very compact in size for its capacity to transfer heat and which can use ordinary, oxidizable fuels such as powdered coal or petroleum based liquids to generate high-pressure, vapor-phase, working fluids within seconds of start up. The fluid heater of this invention includes a housing which has one curved wall and two flat walls and which is provided with a tangential hot gas inlet in the curved wall and an exhaust gas outlet in a central location in one of the side walls so that the flow of hot gas through the housing is in the form of a spiral flowing from the periphery of the housing toward the center and then exhausting along a path that is perpendicular to the spiral flow path through the housing.

Within the housing is a plurality of parallel flow paths for the fluid that is to be heated. Each of the parallel flow paths is a flat helix made of tubing and wound with each winding of the helix in contact with its adjacent winding. Each helix is provided with a first fluid passageway that connects to the inner winding and a second fluid passageway that connects to the outer winding. The first and second fluid passageways pass out of the housing, and the helix along with its first and second fluid passageways forms an enclosed and continuous flow path for fluid. Normally, the first fluid passageway of each flat helix is connected to the same header so that a common source of fluid is provided for all of the helices, and a common header is also provided for all of the second fluid passageways. Normally, for ease of construction, the headers will be located outside of the housing so that each helix is provided with a first passageway and a second passageway that passes through the housing wall; however, this invention includes structures wherein common headers can be positioned within the housing as well as structures where there is no common header connecting the first passageways or the second passageways.

The first passageways pass from outside of the housing to the inner winding of each helix in a critical and specific configuration. The first passageways all have the same shape; all pass through the housing in the same position corresponding to the position to its particular helix; all connect to the inner winding of each particular helix in the same position; and accordingly all are correspondingly located within the housing. This location is such that the first passageway for each helix passes beside the plane of that helix and in contact with each of the tubes of that helix at one point, and collectively the helices are stacked within the housing so that the first passageway of each interior helix is in contact with its own helix and an adjacent helix, and the first passageway of one of the end helices is in contact with the windings of its own helix and with one of the flat walls of the housing. By maintaining all of the helices and all of the first passageways in this configuration, the collective effect of all of the first passageways is to space each helix from its next adjacent helix a distance equal to the width or diameter of the first passageway and to form a barrier to the flow of hot gas so that the hot gas cannot flow between the spaced helices directly from the inlet to the outlet but rather must pass in a long spiral path beyond the point where the first passageways connect to the inner turn of the helices. It is desirable that the hot gases in passing from the hot gas inlet to the hot gas exhaust traverse at least three hundred sixty degrees around a curved and spiral path while in contact with the helical tubes carrying the fluid to be heated. For the most part, the spiral first passageways form a barrier that prevents short circuiting this flow path. However, a suitably formed insert occupying the central cavity within the inner winding of each helix may be provided to insure that the hot gases traverse a path at least three hundred sixty degrees around the housing before passing through the exhaust opening in the side wall of the housing.

It is evident that the first passageway is offset from the plane of its helix by the diameter of the passageway. Either the first passageway or the inner winding of the helix must be bent out of its own plane to be connected together. Since the second passageways do not pass between helices, they may come off of each helix in the same plane as the rest of the windings of the helix.

It is evident that each helix will have one first passageway and that one of the end helices will be in direct contact with a flat housing wall. To avoid this direct contact, which would prevent the helix from being surrounded with hot gas, a spacer having the same shape as the first passageways may be positioned between that end helix and the side wall. Such a spacer will provide a space for hot gas to pass between the end helix and the side wall but will not provide a by-pass for the spiral route of hot gas in passing from the hot gas inlet to the hot gas exhaust opening.

The materials of construction and design criteria of devices embodying this invention will be those known to the art. It is preferred that the housing be constructed of at least three pieces, one being the curved piece and the other two being the flat sidewalls. In this regard it is not essential that the flat sidewalls be perfectly flat, but that they do not bend in a path that describes and establishes the circular flow of gas through the housing. It is preferred that the curved wall and the side walls be made of the same material and if desired, these walls can be provided with cooling fluid, preferably in such manner that the fluid entering the heater be preheated in cooling the walls of the housing. By making all of the housing walls of the same material, problems involving differential thermal expansion can be largely avoided.

Similarly, the diameter and wall thickness of the tubing forming the helices, the first passageways, and the second passageways, should be selected with regard to such factors as the rate of heat transfer that is required and the pressure that must be maintained within the tubing. The housing containing the stacked helices may be of any suitable shape so long as it has a curved wall for directing the flow of hot gas and two flat sidewalls to form the rest of the chamber. The housing may be cylindrical in general shape, but it preferably is volute-shaped so that the flow path of hot gases can follow a path of relatively uniform cross-sectional area as it flows from the periphery of the housing toward its center.

The shape of each indivudal helix is that of a tightly wound spiral where each turn of the spiral is in contact with both of its adjacent turns whereby a barrier to the flow of vapor bypassing through the turns of the helix is avoided. The barrier need not be an absolute barrier so that welding or brazing adjacent turns of the helix is not required. In designing fluid heaters of this invention, the capacity of a heater can be established by selecting how many helices are included in a housing; however, it is essential that the width of the housing be appropriately selected so that the stack of helices and their appropriate spacers fill the housing completely from flat wall to flat wall. It is also within the scope of this invention to provide spacers fixed, as by brazing, to each outer turn of each helix so that the spacing between adjacent outer turns will not be disturbed due to differential expansion. Such spacers should be employed only on the outer turns and should be selected so that their size and shape does not significantly interfere with the flow of hot gas around the periphery of the housing or through the spaces between adjacent helices.

BRIEF DESCRIPTION OF THE DRAWINGS

This invention may be better described with reference to the accompanying drawings.

DESCRIPTION OF THE INVENTION

Figure 1:
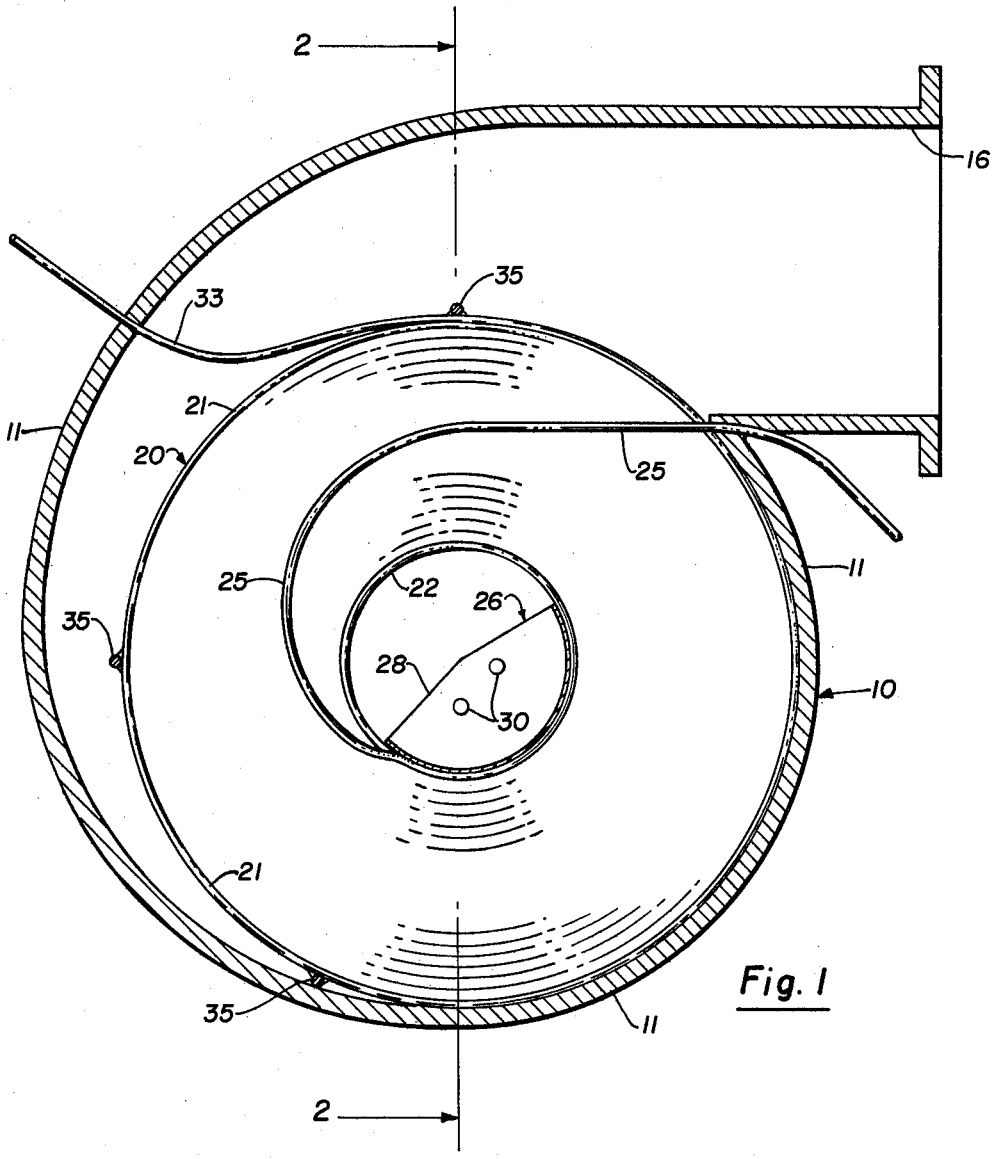
FIG. 1 is a sectional view of a device embodying this invention taken along the line 1—1 of FIG. 2.

The device illustrated in the drawings includes a volute-shaped housing generally designated 10, having a curved wall 11, a flat wall 12, which is provided with an exhaust gas outlet 13, and a flat wall 15. The housing 10 is also provided with a tangential inlet 16 for introducing hot gas into the housing.

Maintained within the housing are a stack of flat helices. One of the helices 17 is an end helix adjacent to the exhaust opening 13. Another of the helices 18 is an end helix located farthest from the exhaust opening 13. All of the other helices 20 are central helices. Each helix has an outer turn 21 and an inner turn 22 and all other turns are intermediate turns. In FIG. 1 the outer turn 21 and the inner turn 22 are illustrated in full, but many of the intermediate turns are illustrated as partial for the sake of convenience and clarity. It is, however, understood that the helix that is illustrated in FIG. 1 is a complete helix made of a continuous piece of tubing.

Figure 4:
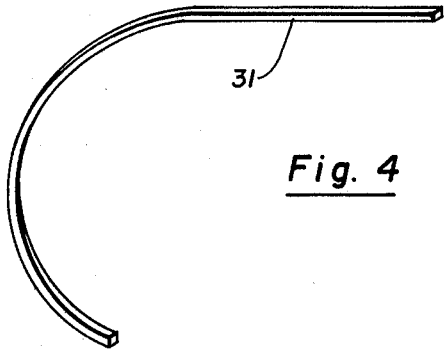
FIG. 4 is a perspective view of a spacer useful in the embodiment of this invention illustrated in FIG. 1 and 2.
Figure 2:
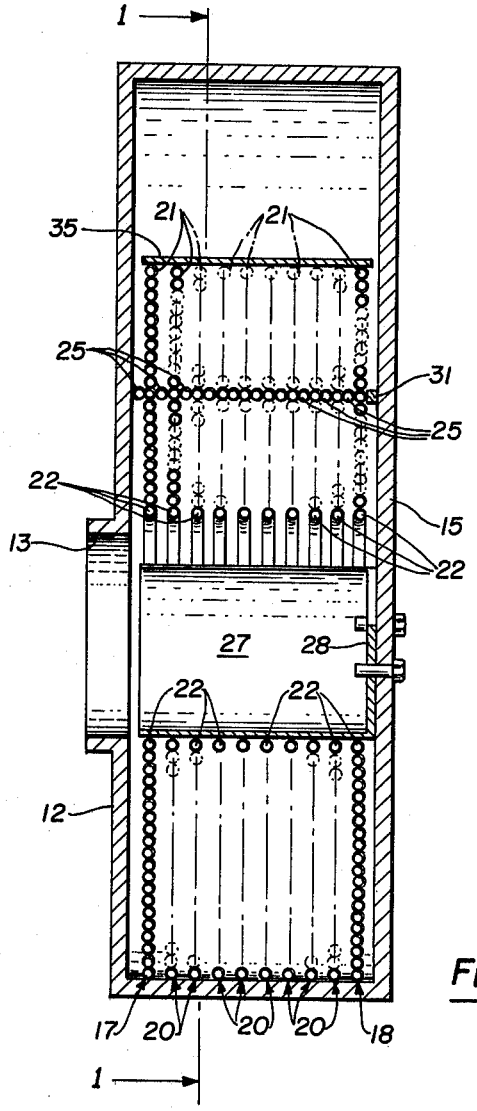
FIG. 2 is a sectional view of the device illustrated in FIG. 1 taken along the line 2—2 of FIG. 1.
Figure 3:
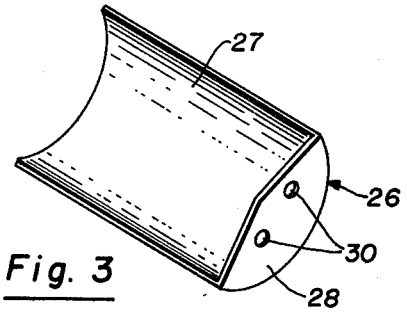
FIG. 3 is a perspective view of a deflector useful in the embodiment of this invention illustrated in FIGS. 1 and 2.

A first passageway 25 extends from the curved housing wall 11 to inner winding 22 of each helix. This first passageway is itself helical in shape and passes so that it is in contact with outer winding 21, all intermediate windings, and connects directly to inner winding 22 to form a continuous fluid passageway. As best illustrated in FIG. 2, each first passageway is in contact with two helixes and maintains them spaced from one another a distance equal to the outside diameter of the first passageway 25. Helix 17, which is one of the outside helices, is spaced from the wall 12 by first passageway 25. The cooperative effect of the tightly wound helices and contact maintained between them and first passageway 25 creates a group of volute-shaped parallel passageways through which hot gas entering inlet 16 must pass in a spiral flow to ultimately discharge into the cavity formed by inner windings 22. The gas flow entering inlet 16 must be between the lower portion of curved wall 11 and the upper portion of first passageway 25, as illustrated in FIG. 1, until it passes the point where first passageway 25 joins inner winding 22. At that point the hot gases could enter the cavity formed by inner winding 22. However, in a preferred embodiment a deflector, generally designated 26 and best illustrated in FIG. 3, is inserted into the cavity so that the flow of hot gas cannot enter the cavity but must continue to flow between helices. At some point, the hot gases are deflected by the underside of first passageway 25 as it is illustrated in FIG. 1, and the hot gases are then deflected toward the cavity formed by inner winding 22. By properly shaping and positioning deflector 26 the hot gases must traverse a path of more than 360° in flowing from the inlet 16 to the cavity formed by the inner windings 22. This cavity is preferably aligned with exhaust outlet 13 so that the gases, after flowing more than once around the interior of the housing 10, may change flow direction by 90° and exhaust through the exhaust opening 13. The deflector 26 includes a cylindrical segment portion 27 and an end cap portion 28 which prevents hot gases from entering the cavity in the space between end helix 18 and sidewall 15. The partial end cap 28 is illustrated as containing two holes 30, which, as best illustrated in FIG. 2, may receive pins or bolts to fix deflector 26 in the proper position with respect to the points where first passageways 25 are joined to inner winding 22. FIG. 2 also illustrates spacer 31 which is illustrated in FIG. 2 and in FIG. 4 as having a square cross section. Spacer 31 is positioned with respect to end helix 18 in the same manner as first passageway 25, however, it abuts flat wall 15 instead of being between adjacent helices. Spacer 31 is necessary to complete the barrier to the flow of hot gases except around the path defined by curved wall 11, first passageways 25, and deflector 26. Spacer 31 may have any suitable cross section and it may be fixed either to wall 15 or to helix 18, however it must conform in its elongated shape and its position with respect to the housing with the elongated shape and position of the first passageway 25.

Second passageways 33 simply pass from the outer winding 21 of each helix through the curved wall 11 of the housing. The second passageways 33 may have any shape and they will be spaced from one another a distance equal to the diameter of first passageways 25. To avoid distortion of the helices due to thermal expansion and contraction, a number of spacers 35 may be fixed between the outer winding 21 of the helices 20. These spacers 35 must be of such a shape as to not severely interfere with the flow of hot gases and preferably are tubes or bars which are brazed or otherwise connected to the outer windings only.

The device as illustrated and described functions as follows. Hot gas from any suitable source is introduced as a flowing stream through the hot gas inlet 16. The hot gas is preferably gas generated in the combustion of material such as powdered coal or petroleum distillates. Although the source of the hot gas is not a limitation on this invention, the free flow paths of the fluid heater of this invention permit a great deal of latitude in the source of heating fluid. For example, material such as powdered coal may readily be used in that the ash content of the coal, although very low, would cause problems of accumulation in heaters that were not constructed with smooth surfaces, axially designed flow paths, and a construction which tends to be self-cleaning rather than to provide sharp corners or obstructed areas where detrimental materials could accumulate. The hot gases entering inlet 16 first flow in the spaces between the helices that are above first passageways 25. The hot gases flow between second passageways 33 and are forced between the helices by the diminishing space between curved wall 11 and outer winding 21 in the direction of gas flow. By the time the gas flows 180° from the inlet the outer winding 21 is in contact with curved wall 11 and the gas is restricted from entering the cavity within inner winding 22 so that it must flow in the spaces between adjacent helices until it passes the position occupied by deflector 26 and has its flow interupted by encountering the bottom of first passageways 25. The gas is then deflected by the lower portion of the helical first passageways to direct it into the cavity formed by inner winding 22 wherein the gases change direction 90° and flow out through exhaust opening 13. The long term, intimate, large-surface area contact between the hot gases entering inlet 16 and the numerous heat transfer surfaces formed by helices 17, 18, and 20, provide ideal conditions for transferring heat from the hot gases to the fluids within the tubes. The configuration of the housing with respect to the helices is such that there is small frictional impediment to passing the hot gases between the helices at high velocity which in turn produces thin films to increase the heat transfer rate from the hot gases to the tubes forming the helices.

In a typical embodiment of this invention, a fluid heater is made to vaporize a working fluid for an external combustion engine. The helices are made of stainless steel and the tubing is ⅝-inch O.D. Each helix has 32 wrappings between the inner wrapping and the outer wrapping and the internal cavity is dimensioned such that the overall diameter of the helix is about one foot. A housing containing 24 such helixes assembled as described hereinabove and accepting hot gas from the combustion of powdered coal is capable of generating vapor phase working fluid at 1000 psi in a period of less than ten seconds. Of course, a system employing such a vapor generator must include a prime mover which is capable of generating power by expanding the vapors, a condenser to liquify the expanded vapors, and a pump to drive the resultant liquid through the fluid heater of this invention. The fluid heater described hereinabove not only can generate the working vapor in less than 10 seconds, but it is capable, with a suitable hot gas feed, of providing enough high pressure vapor for that vehicle to operate under ordinary highway conditions.

What is claimed is:

1. A fluid heater comprising a housing having a curved wall and two flat side walls and having a tangential hot gas inlet in said curved wall and a gas outlet opening from a central portion of a flat side wall, a plurality of flat helices of tubing within said housing with each helix woulnd with each turn in contact with its adjacent turn, a first fluid passageway passing from the interior turn of each helix to a position beyond the outer turn with said first passageway offset from the plane of said helix and contacting each turn of said helix at one point, said plurality of helices stacked with said first fluid passageways in corresponding positions and bending toward the inner winding of each helix in the direction of gas flow through the housing, and said first passageways in contact with the next adjacent helix whereby said helices are spaced from one another a distance equal to the diameter of said first passageway, and whereby said first passageways collectively form a barrier to the flow of hot gas between adjacent helices, a second fluid passageway passing from the outer turn of each helix, said first passageways and second passageways passing through said housing, each helix with its first passageway and second passageway forming a continuous fluid flow path, and means to introduce fluid into one of said first passageway and said second passageway.

2. The fluid heater of claim 1 wherein a cylindrical segment having at least one open end opening in the direction of said gas outlet is positioned in a cavity formed by the collective inner windings of said helices such that said cylindrical segment acts as a barrier to the flow of hot gas between the inner windings of said helices.

3. The fluid heater of claim 1 wherein a spacer having the elongated shape of said first passageway is positioned between one flat wall of said housing and the helix adjacent to said first wall with said spacer positioned to correspond with the position of said first passageway with respect to said tangential inlet.

4. The fluid heater of claim 1 wherein a spacer is positioned in contact with the outer windings of each of said helices and said outer windings are fixed to said spacer a distance equal to one first passageway diameter from each other.

5. The fluid heater of claim 1 wherein one of said first passageway and said passageway is a liquid inlet and the other is a vapor outlet.

6. The fluid heater of claim 1 wherein all liquid inlets are connected to a common source of liquid which is maintained under superatmospheric pressure.

* * * * *

UNITED STATES PATENT OFFICE

CERTIFICATE OF CORRECTION

PATENT NO. : 4,077,468

DATED : March 7, 1978

INVENTOR(S) : Marshall L. Owen and Rudolf F. Nissen

It is certified that error appears in the above-identified patent and that said Letters Patent are hereby corrected as shown below:

In column 5, line 55, change "5/8-inch" to --1/8-inch--.

In column 6, line 50, change "first" to --flat--.

In column 6, line 59, after "said" insert --second--.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*